US008571796B2

(12) United States Patent
Van Os et al.

(10) Patent No.: US 8,571,796 B2
(45) Date of Patent: Oct. 29, 2013

(54) DEVICE AND METHOD OF DETERMINING RATE OF PENETRATION AND RATE OF ROTATION

(75) Inventors: Roel Van Os, Chatenay-Malabry (FR); Dominique Dion, Plaisir (FR); Philip Cheung, Montesson (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 320 days.

(21) Appl. No.: 12/956,394

(22) Filed: Nov. 30, 2010

(65) Prior Publication Data

US 2011/0172923 A1 Jul. 14, 2011

Related U.S. Application Data

(63) Continuation-in-part of application No. 12/159,556, filed as application No. PCT/EP2007/000093 on Jan. 8, 2007, now Pat. No. 7,873,475.

(30) Foreign Application Priority Data

Jan. 10, 2006 (EP) ..... 06290061

(51) Int. Cl.
*G06F 19/00* (2011.01)

(52) U.S. Cl.
USPC ..... 702/6

(58) Field of Classification Search
USPC ..... 702/6, 182–185, 188
See application file for complete search history.

(56) References Cited

U.S. PATENT DOCUMENTS

| | | | | |
|---|---|---|---|---|
| 4,251,773 | A | 2/1981 | Cailliau et al. | |
| 5,519,668 | A | 5/1996 | Montaron | |
| 5,812,068 | A | 9/1998 | Wisler et al. | |
| 5,930,730 | A | 7/1999 | Marfurt et al. | |
| 6,151,961 | A | 11/2000 | Huber et al. | |
| 6,405,136 | B1 | 6/2002 | Li et al. | |
| 7,873,475 | B2 | 1/2011 | Van Os et al. | |
| 2006/0271299 | A1 * | 11/2006 | Ward et al. | 702/6 |

FOREIGN PATENT DOCUMENTS

| | | |
|---|---|---|
| EP | 0541425 | 5/1993 |

* cited by examiner

*Primary Examiner* — Edward Raymond
(74) *Attorney, Agent, or Firm* — Stephanie Chi; Darla Fonseca; Jody DeStefanis

(57) ABSTRACT

Methods and devices for determining a rate of penetration and/or rate of rotation for a drilling assembly or logging tool while drilling or logging a wellbore are provided. The methods can include the steps of:

at respective first and second time instant, acquiring and storing a first logging data frame using a first array of sensors and a second logging data frame using a second array of sensors where wherein the logging data relate to at least one property of a zone surrounding the wellbore and the second logging data frame overlaps at least partially the first logging data frame;

comparing the first and second logging data frames;

determining a relative change in depth and/or azimuth between the first and second logging data frames; and calculating the rate of penetration and/or rate of rotation based on the relative change in depth and/or azimuth determined and a difference between the first and second time instants.

16 Claims, 7 Drawing Sheets

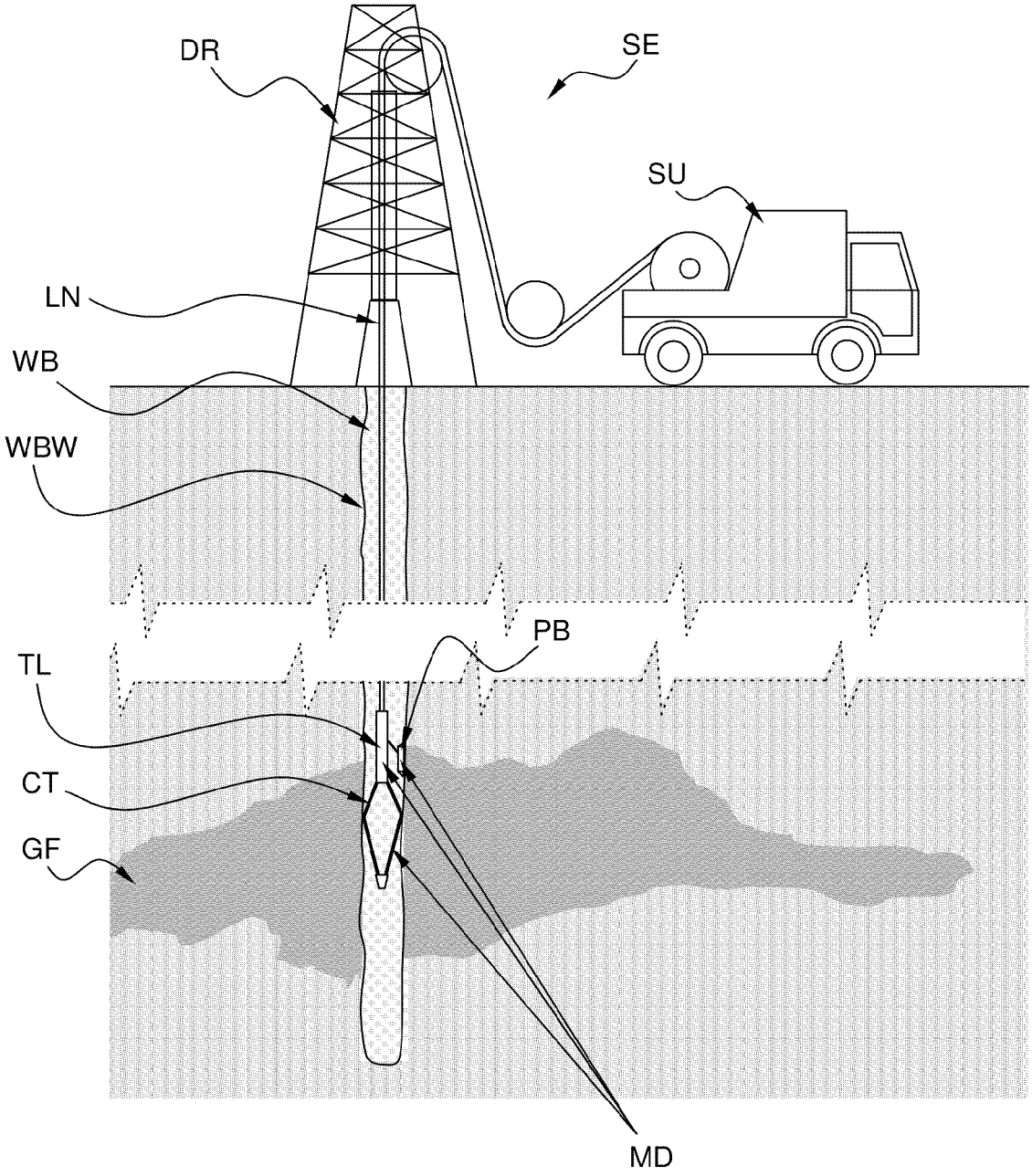
FIG. 1.A

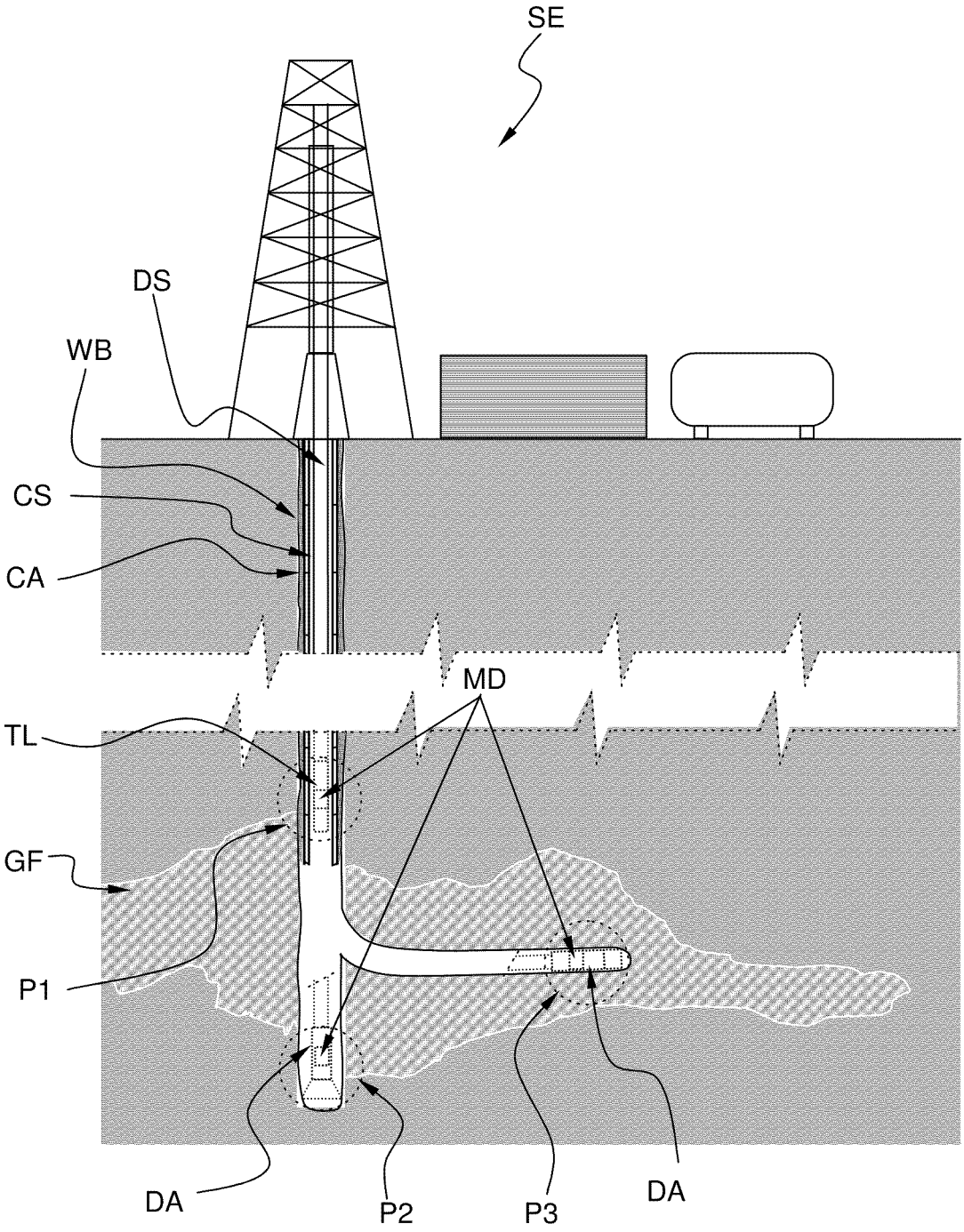
FIG. 1.B

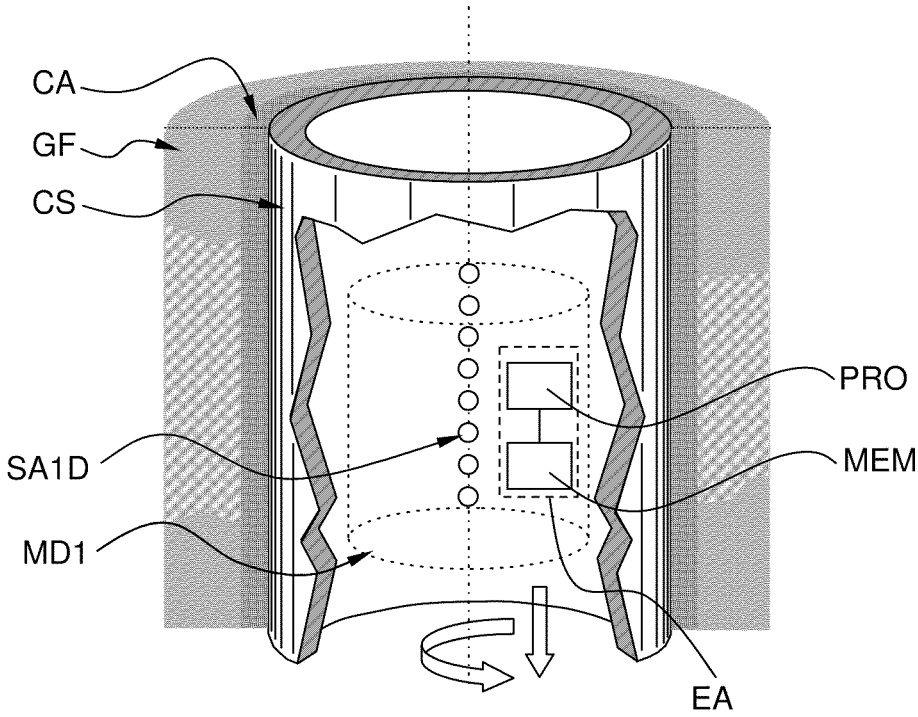
FIG. 2.A
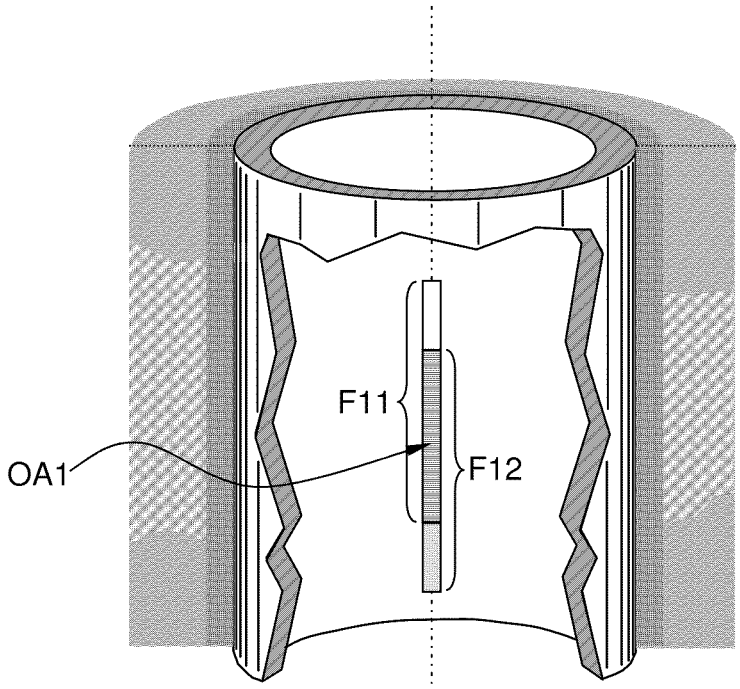
FIG. 2.B

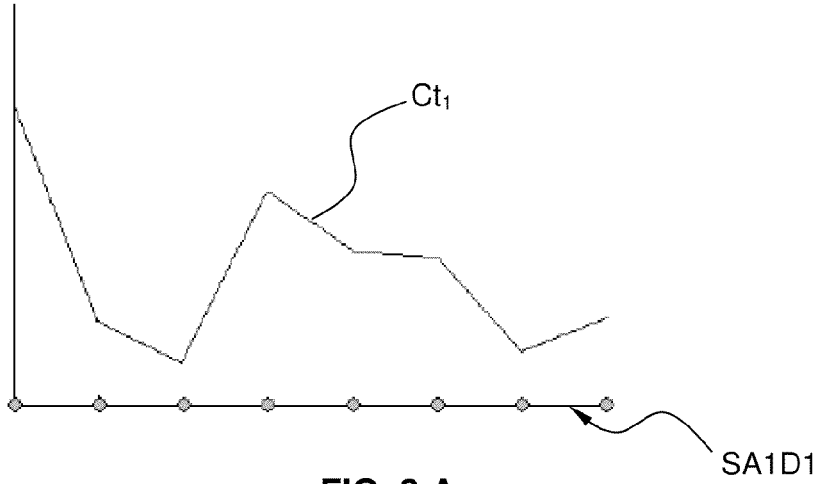
FIG. 3.A
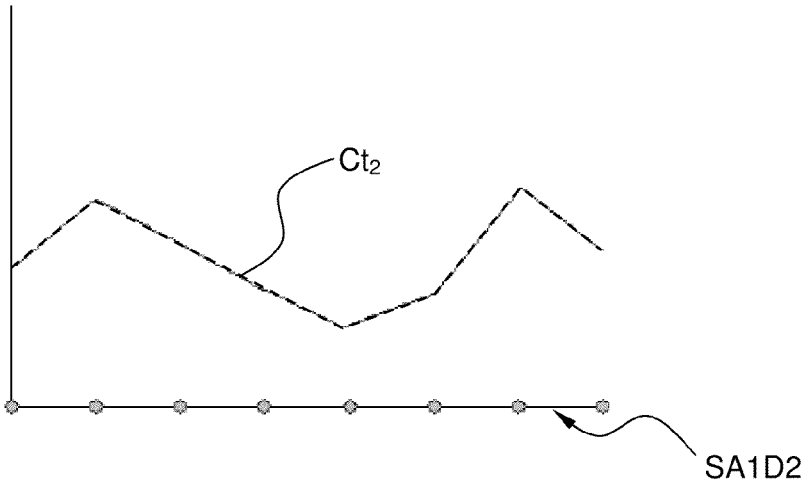
FIG. 3.B
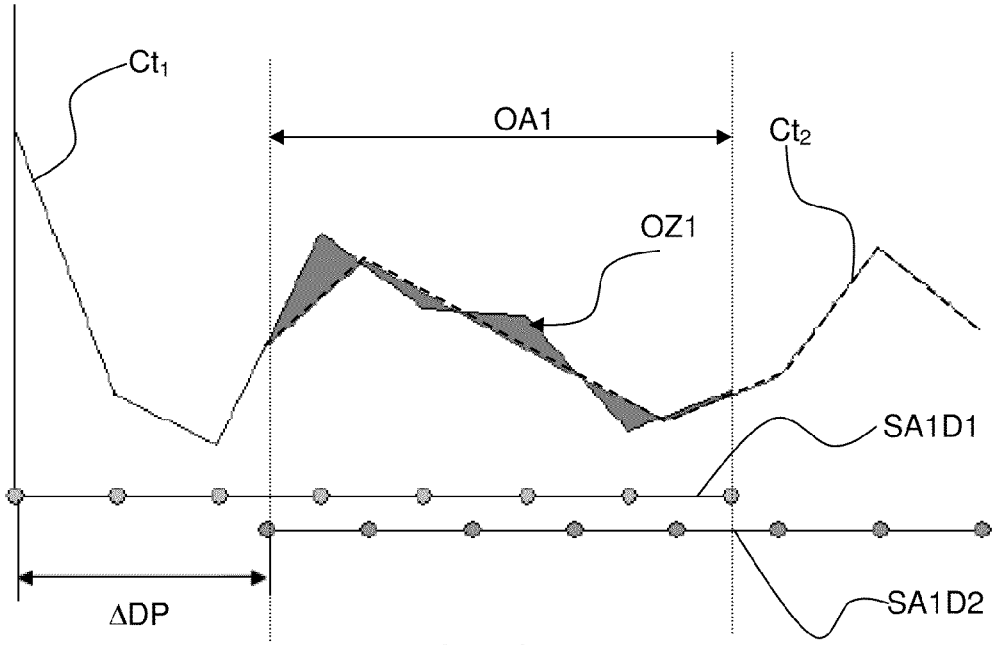
FIG. 3.C

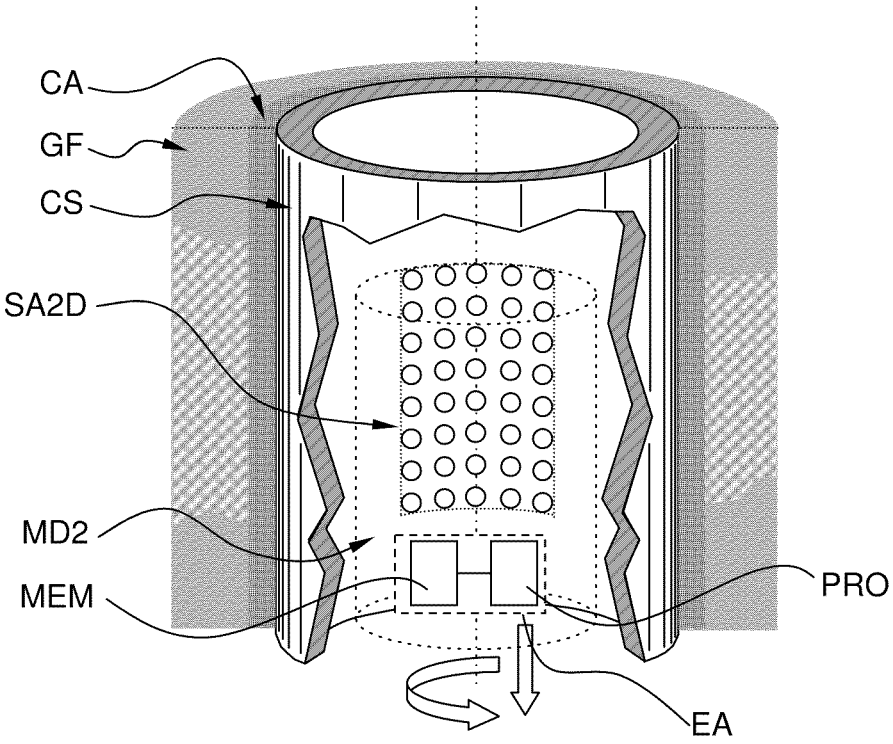
FIG. 4.A
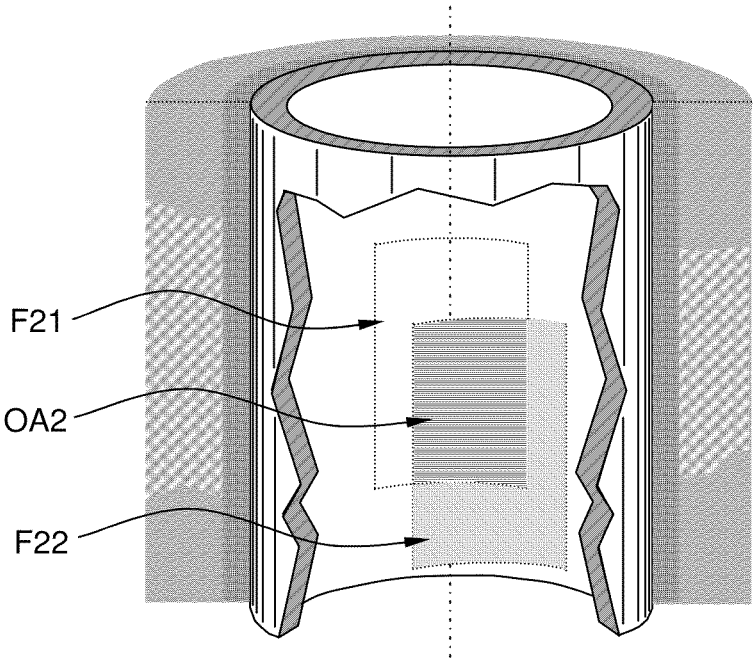
FIG. 4.B

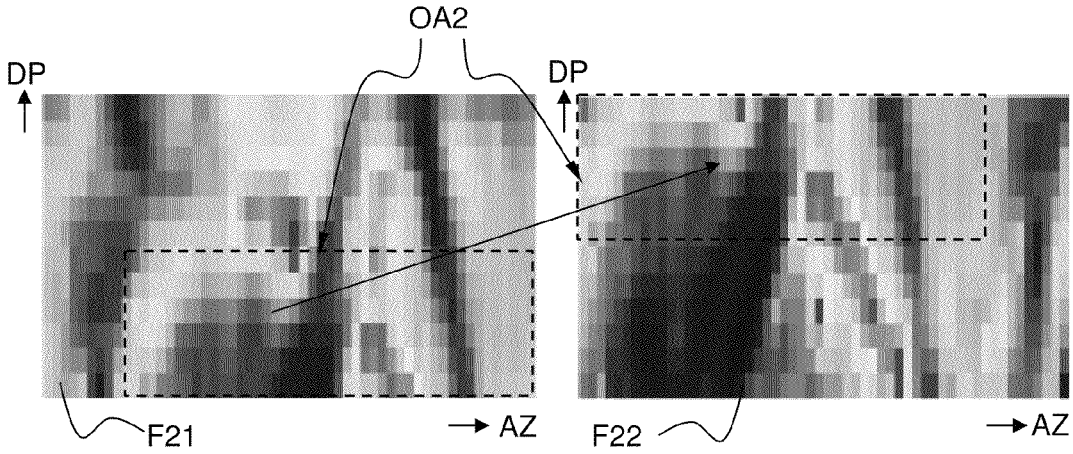
FIG. 5.A FIG. 5.B
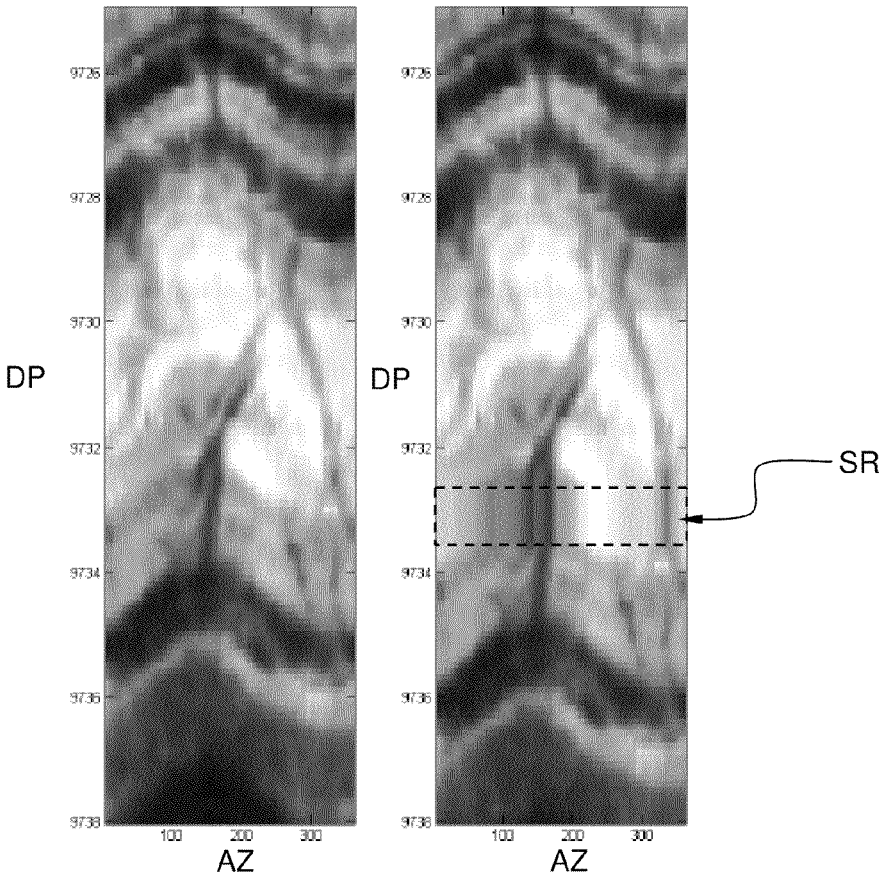
FIG. 6.A FIG. 6.B

DEVICE AND METHOD OF DETERMINING RATE OF PENETRATION AND RATE OF ROTATION

CROSS REFERENCE TO RELATED APPLICATIONS

This application is a continuation-in-part of U.S. patent application Ser. No. 12/159,556.

TECHNICAL FIELD

This disclosure relates to a method of determining a rate of penetration and/or rate of rotation of a drilling assembly or logging tool while drilling or logging a wellbore, and a device for determining a rate of penetration and/or rate of rotation according to the same method.

Other aspects of this disclosure relate to a logging tool and a drilling assembly.

A particular application of the method and the logging tool or drilling assembly according to this disclosure relates to the oilfield services industry.

BACKGROUND

Many techniques are known to measure the depth as well as the azimuth of downhole assemblies deployed within a wellbore. The downhole assemblies may be a logging tool (used in wireline application) or a drilling assembly (used in drilling and logging while drilling applications) which comprise a plurality of sensors for measuring properties of the geological formation surrounding the wellbore.

Typically, in wireline application, the logging tool is connected to a surface equipment via a logging cable. The depth of the logging tool is determined by means of a calibrated measure wheel at the surface. The wheel has a known circumference and is rotated by the logging cable when the logging tool is run into the wellbore. The depth may be corrected by taking into account the stretch of the cable due to the weight of the cable in the wellbore, the weight of the logging tool and the history of the cable stretch characteristics change with usage.

Typically, in logging while drilling application, the drilling assembly is connected to a surface equipment via a drill string. The depth of the drilling assembly is determined by measuring the length of pipe that enters the well at surface. The depth may be corrected for the effects of drill string tension or compression.

During the deployment and operation of the logging tool and drilling assembly, these downhole assemblies may move erratically within the well bore (e.g. bouncing effects, sticking and releasing effects, friction, compression or tension of the pipe or cable). Thus, it is often difficult to estimate at a particular instant the precise depth of the downhole assembly. In addition, in logging while drilling application, an additional error is introduced by the lack of synchronization between the uphole and downhole clocks. As a consequence, log produced by the sensors of the downhole assembly will be incorrect as a result of the errors made when correlating measurements performed by the sensors of the downhole assembly with depth measurements made at the surface. Further, the aforementioned estimated depths will be insufficiently precise for high resolution measurements such as images.

SUMMARY

It is an object of this disclosure to propose a rate of penetration and/or rate of rotation determining device and method that overcomes at least one of the drawbacks of the prior art.

According to an aspect, this disclosure relates to a method of determining a rate of penetration and/or rate of rotation of a drilling assembly or logging tool while drilling or logging a wellbore, the method comprising the steps of:

- at a first time instant, acquiring and storing a first logging data frame using a first array of sensors, and, at a second time instant, acquiring and storing a second logging data frame using a second array of sensors the logging data relate to at least one property of a zone surrounding the wellbore, the second logging data frame overlaps at least partially the first logging data frame,
- comparing the first and second logging data frames,
- determining a relative change in depth and/or azimuth between the first and second logging data frames,
- calculating the rate of penetration and/or rate of rotation based on the relative change in depth and/or azimuth determined and a difference between the first and second time instants.

In some implementations, the first and second sensor arrays are the same sensor array.

Optionally, the method may further comprise the steps of correlating the rate of penetration and/or rate of rotation calculated to a time correspondent measurement of a depth and/or azimuth of the drilling assembly or logging tool made by a measuring device at the earth's surface or elsewhere at the assembly or tool (for instance, downhole using magnetometers for example), and correcting the measurement of the depth and/or azimuth of the drilling assembly or logging tool made by the measuring device at the earth's surface or elsewhere at the assembly or tool.

Optionally, the method may further comprise the steps of calculating an actual depth and/or azimuth of the drilling assembly or logging tool based on the relative change in depth and azimuth determined, and correcting a time correspondent measurement of a depth and/or azimuth of the drilling assembly or logging tool made by a measuring device at the earth's surface or elsewhere at the assembly or tool using the actual depth and azimuth calculated.

The step of comparing the first and second logging data frames may include determining an overlapping area between the first and second logging data frames. Hence, the displacement of one frame relative to the other can be determined.

The step of determining the overlapping area may include either evaluating the coherence of the first and second logging data frames by applying a correlation method on both logging data frames, or alternatively evaluating the similarity of the first and second logging data frames by applying a semblance method on both logging data frames.

The logging data may be mechanical, electromagnetic, nuclear, acoustic, or ultrasonic measurements.

The first and second logging data frames may be 1D images or 2D images.

In some implementations, the method is carried out by a non-transitory computer readable medium that contains computer instructions stored therein for causing a computer processor to perform a program for a rate of penetration and/or rate of rotation determining device that is arranged to be deployed into the wellbore, the program comprising a set of instructions that, when loaded into a program memory of the rate of penetration and/or rate of rotation determining device, causes the rate of penetration and/or rate of rotation determining device to carry out the steps of the method of determining a rate of penetration and/or rate of rotation according to this disclosure.

According to a further aspect, this disclosure relates to a device for determining a rate of penetration and/or rate of rotation of a drilling assembly or logging tool while drilling or logging a wellbore, the device is coupled to at least a sensor array for measuring logging data related to at least one property of a zone surrounding the wellbore and comprises a memory buffer and at least one processing module, wherein the processing module of the rate of penetration and/or rate of rotation determining device is arranged to:

at respective first and second time instant, acquire and store into the memory buffer a first logging data frame using a first array of sensors and a second logging data frame using a second array of sensors, the second logging data frame overlaps at least partially the first logging data frame, compare the first and second logging data frames, determine a relative change in depth and/or azimuth between the first and second logging data frames, and calculate the rate of penetration and/or rate of rotation based on the relative change in depth and/or azimuth determined and a difference between the first and second time instants.

In some embodiments, the first and second sensor arrays are the same sensor array. In some embodiments, the first and second sensor arrays comprise a 1D sensor array or a 2D sensor array.

Optionally, the processing module of the rate of penetration and/or rate of rotation determining device may be further arranged to correlate the rate of penetration and/or rate of rotation calculated to a time correspondent measurement of a depth and/or azimuth of the drilling assembly or logging tool made by a measuring device at the earth's surface or elsewhere at the assembly or tool (for instance, downhole using magnetometers for example), and correct the measurement of the depth and/or azimuth of the drilling assembly or logging tool made by the measuring device at the earth's surface or elsewhere at the assembly or tool.

Optionally, the processing module of the rate of penetration and/or rate of rotation determining device may be further arranged to calculate an actual depth and/or azimuth of the drilling assembly or logging tool based on the relative change in depth and azimuth determined, and correct a time correspondent measurement of a depth and/or azimuth of the drilling assembly or logging tool made by a measuring device at the earth's surface or elsewhere at the assembly or tool using the actual depth and azimuth calculated.

According to still a further aspect, this disclosure relates to a logging tool arranged to be deployed into a wellbore and comprising at least a sensor array for measuring logging data related to at least one property of a zone surrounding a wellbore, wherein the logging tool comprises the rate of penetration and/or rate of rotation determining device according to this disclosure.

According to still a further aspect, this disclosure relates to a drilling assembly arranged to drill a wellbore and comprising at least a sensor array for measuring logging data related to at least one property of a zone surrounding a wellbore, wherein the drilling assembly comprises the rate of penetration and/or rate of rotation determining device according to this disclosure.

Thus, this disclosure enables an accurate estimation of the rate of penetration and/or the rate of rotation of a downhole assembly moving in an open or cased wellbore during a given time period or at a given depth and/or azimuth interval, based on the relative depth and/or the relative azimuth of the downhole assembly determined for that period or interval.

The measurements used to determine the rate of penetration and/or rate of rotation may be the primary measurements of a downhole assembly (e.g. the measurements related to the imaging of geological formation resistivity) or may be auxiliary measurements measured by one or more specific sensor arrays. In particular, the method of this disclosure is particularly simple to implement when the measurements of a physical property of the surrounding zone method are themselves used to determine the relative depth and/or the relative azimuth which can then be used to calculate the rate of penetration and/or the rate of rotation. As a consequence, accurate logs can be produced with the method and device of this disclosure.

Further, the relative and actual depth and/or azimuth estimated and the corresponding rate of penetration and/or rate of rotation calculated according to this disclosure can be used to improve the analysis and interpretation of data acquired on the downhole assembly, in particular images and other measurements (e.g., depth measurements made by a surface measuring device) that require knowledge of the relative or actual positions of the data acquired.

Finally, this disclosure also enables determining the absolute depth and/or the absolute azimuth of a downhole assembly.

These and other aspects of this disclosure will be apparent from and elucidated with reference to the embodiments described hereinafter.

BRIEF DESCRIPTION OF THE DRAWINGS

The present disclosure is illustrated by way of example and not limited to the accompanying figures, in which like references indicate similar elements:

FIG. 1.A schematically illustrates a typical onshore hydrocarbon well location and a logging application of the invention;

FIG. 1.B schematically illustrates a typical onshore hydrocarbon well location and a logging while drilling application of the invention;

FIG. 2.A is a cross-section into a portion of a cased wellbore schematically illustrating a first embodiment of a device for measuring depth and/or azimuth of logging data according to the invention;

FIG. 2.B is a cross-section into a portion of a cased wellbore schematically illustrating the implementation of the method of measuring depth and/or azimuth of logging data with the first embodiment of the invention shown in FIG. 2.A;

FIGS. 3.A, 3.B and 3.C schematically illustrate a method of measuring depth and/or azimuth of logging data implemented by the first embodiment of the invention shown in FIG. 2.A;

FIG. 4.A is a cross-section into a portion of a cased wellbore schematically illustrating a second embodiment of a device for measuring depth and/or azimuth of logging data according to the invention;

FIG. 4.B is a cross-section into a portion of a cased wellbore schematically illustrating the implementation of the method of measuring depth and/or azimuth of logging data with the second embodiment of the invention shown in FIG. 4.A;

FIGS. 5.A and 5.B schematically illustrate the method of measuring depth and/or azimuth of logging data implemented by the second embodiment of the invention shown in FIG. 4.A;

FIGS. 6.A and 6.B schematically illustrate logging data measured with a logging tool or a drilling apparatus where depth was measured according to the invention and according to the prior art, respectively;

DETAILED DESCRIPTION OF THE INVENTION

Figure 7:
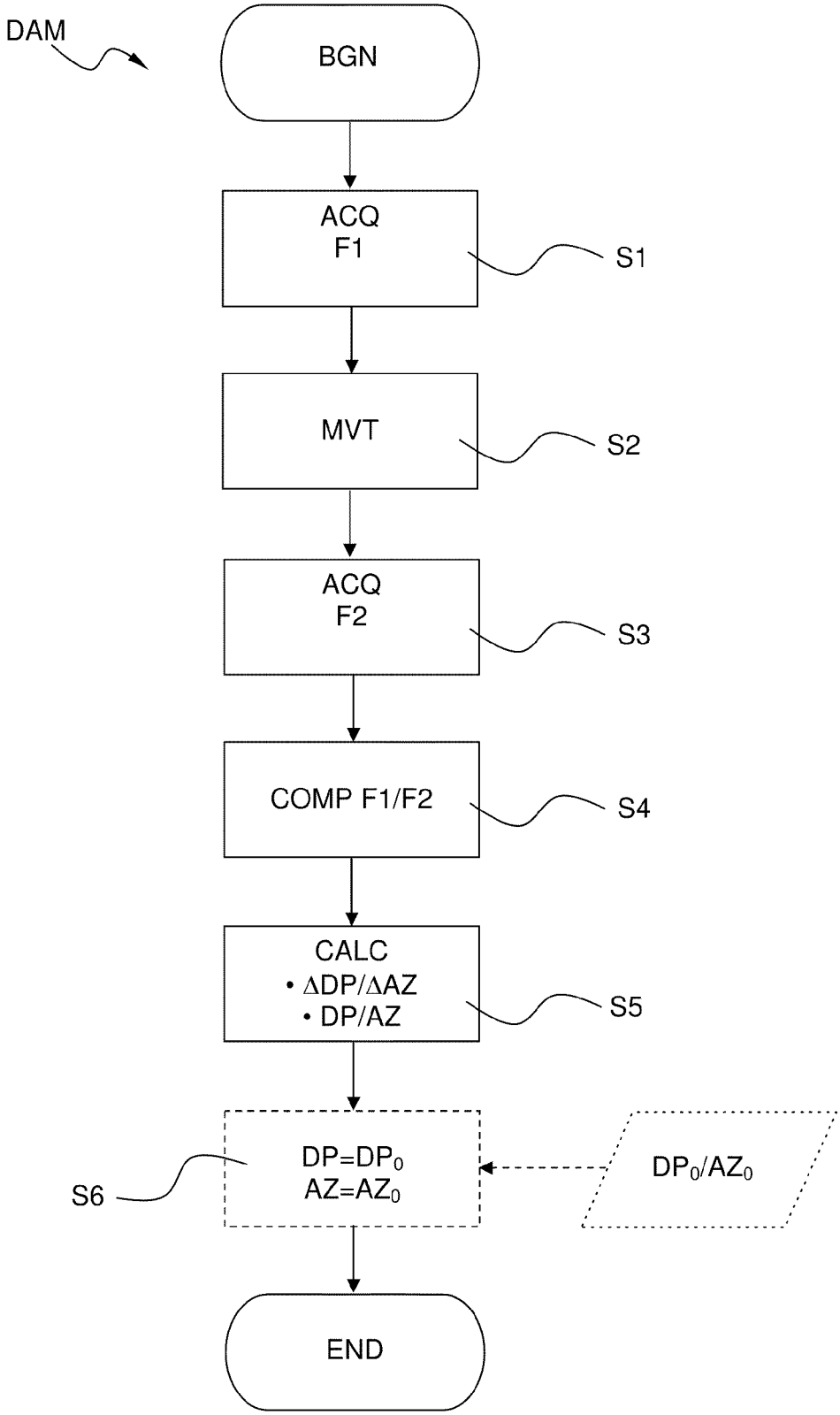
FIG. 7 is a block diagram illustrating the method of measuring depth and/or azimuth of logging data according to the invention.

In the following description the wording "depth", "azimuth", "property of a zone surrounding a wellbore" will have the following meaning.

The "depth" describes a measure of displacement of a device along a trajectory.

The "azimuth" describes the rotation of the device about the axis of the trajectory, relative to a reference which may be a projection of the gravity or magnetic field vector on a plane perpendicular to said axis.

The "property of a zone surrounding a wellbore" means either:

- in the case of open hole, the physical or geometrical properties of the geological formation,
- in the case of cased hole, the physical or geometrical properties of the pipe, the casing, the cemented annulus or the geological formation behind the casing, The physical or geometrical properties may be measured by, for example, mechanical, electromagnetic, nuclear or acoustic sensors.

FIG. 1.A schematically shows a typical onshore hydrocarbon well location and surface equipments SE above a hydrocarbon geological formation GF after drilling operation has been carried out. At this stage, i.e. before a casing string is run and before cementing operations are carried out, the wellbore WB is a bore hole filled with a fluid (e.g. a drilling fluid or mud).

Well logging operation may be carried out. The well logging operation serves to measure various parameters of the hydrocarbon well geological formation (e.g. resistivity, porosity, etc. . . . at different depths) and in the well-bore (e.g. temperature, pressure, fluid type, fluid flowrate, etc. . . . at different depths). Such measurements are performed by a logging tool TL. Generally, a logging tool comprises at least one sensor (e.g. resistivity sonde, mechanical sonde, gamma ray neutron sonde, accelerometer, pressure sensor, temperature sensor, etc. . . . ) and measures at least one parameter. In some embodiments, the logging tool comprises one or more sensor arrays, each array having two or more sensors. At any given time, different sensor arrays can measure different parts of a formation surrounding a wellbore. Correlations described hereinafter can be performed to determine at which instant one sensor array measures the part of the formation that has been measured by the same senor array or another sensor array at an earlier instant. This can provide the change in depth and/or azimuth between the two time instants. This change in depth and/or azimuth can then be used to calculate rate of penetration and/or rate of rotation as described hereinafter. The use of an array of multiple sensors allows for measurements that are not stretched or compressed even if the rate of penetration and/or rate of rotation may vary during the measurements. The correlations based on such measurements can be more robust than the correlations based on measurements made by a single sensor. By using an array of multiple sensors, a relatively better overlap of data can be obtained at an expanded range of rate of penetration and rate of rotation combinations. Such better overlapped data often provides a stronger correlation. It may include a plurality of same or different sensors sensitive to one or more parameters. The logging tool is moved up and down in the borehole by means of a cable LN and gathers data about the various parameters. The logging tool may be deployed inside the well-bore by an adapted surface equipment SE that may include a vehicle SU and an adapted deploying system, e.g. a drilling rig DR or the like. Data related to the hydrocarbon geological formation GF or to the well-bore WB gathered by the logging tool TL may be transmitted in real-time to the surface, for example to the vehicle fitted with an appropriate data collection and analysis computer and software.

The logging tool TL may comprise a centralizer CT. The centralizer comprises a plurality of mechanical arm that can be deployed radially for contacting the well-bore wall WBW. The mechanical arms insure a correct positioning of the logging tool along the central axis of the well-bore hole. The logging tool TL comprises various sensors and provides various measurement data related to the hydrocarbon geological formation GF, or to the casing that may be present in the borehole, or to the cemented casing. These measurement data are collected by the logging tool TL and transmitted to the surface unit SU. The surface unit SU comprises appropriate electronic and software arrangements for processing, analyzing and storing the measurement data provided by the logging tool TL.

The logging tool TL may also comprise a probe PB for measuring a physical property (e.g. the density) of the subsurface formation surrounding the wellbore. Once the logging tool is positioned at a desired depth, the probe PB can be deployed from the logging tool TL against the bore hole wall WBW by an appropriate deploying arrangement (e.g. an arm).

The device for measuring depth and/or azimuth MD of logging data of this disclosure may be fitted anywhere on the logging tool TL, including the probe PB and the centralizer CT.

FIG. 1.B schematically shows a typical onshore hydrocarbon well location and surface equipments SE above a hydrocarbon geological formation GF after a well-bore WB drilling operation has been carried out, after a casing string CS has been partially run and after cementing operations have been partially carried out for sealing the annulus CA (i.e. the space between the well-bore WB and the casing string CS) in order to stabilize the well-bore.

Typically, the surface equipments SE comprise a plurality of mud tanks and mud pumps, a derrick, a drawworks, a rotary table, a power generation device and various auxiliary devices, etc. . . .

At this stage, various operations may be carried out, either logging or further drilling operations that are shown in FIG. 1.B.

For example, a logging tool TL may be deployed into a first portion P1 of the well-bore which is a cased portion in order to perform logging operation. The logging tool TL was described in relation with FIG. 1 and will not be further described. The device for measuring depth and/or azimuth MD of logging data of this disclosure may be fitted within the logging tool TL.

Further, a drilling assembly DA may be deployed into a second portion P2 and a third portion P3 in order to perform further drilling operation. The second portion P2 of the well-bore is an open bore hole. The third portion P3 of the well-bore is a sensibly horizontal lateral bore hole.

The drilling assembly DA is coupled to the surface equipments with a drill string DS. The device for measuring depth and/or azimuth MD of logging data of this disclosure may be fitted anywhere within the drilling assembly DA in order to perform logging while drilling.

It is emphasized that the surface equipments SE, the logging tool TL and the drilling assembly DA shown in FIGS. 1.A and 1.B may comprise other components that are not shown for clarity reasons.

The measuring device according to a first and second embodiment of this disclosure that will be described in relation with FIG. 2.A and 4.A, respectively, may be fitted in any type of downhole assembly (logging tool, drilling assembly, or any other tool conveyed in any other fashion). The downhole assembly may be rotated clockwise or counterclockwise, move up or down into the wellbore resulting in a positive or negative variation of the depth and/or azimuth of the downhole assembly into the wellbore.

FIG. 2.A schematically shows a cross-section into a portion of a cased wellbore and illustrates the depth and/or azimuth measuring device MD1 according to a first embodiment of this disclosure.

The depth and/or azimuth measuring device MD1 is coupled to a 1D sensor array SA1D. In the example of FIG. 2.A, the 1D sensor array comprises 8 sensors and is positioned substantially vertically, thus enabling measuring depth. Alternatively, it will be apparent that the 1D sensor array may also be positioned substantially horizontally (not shown), thus enabling measuring azimuth. The 1D sensor array may be a specific sensor which function is only to be used in the determination of the depth and/or azimuth. Alternatively, the 1D sensor array may be part of the logging tool TL or the drilling assembly DA (see FIGS. 1.A and 1.B) which function is to determine the physical property of the zone surrounding the wellbore, e.g. the geological formation GF, the casing CS or the cemented casing. In this example, the sensor array SA1D comprises resistivity sensors and provides imaging of geological formation resistivity.

The depth and/or azimuth measuring device MD1 comprises an electronic arrangement EA comprising a memory buffer MEM coupled to a processing module PRO. The processing module PRO is coupled to the 1D sensor array (SA1D).

The method of measuring depth and/or azimuth of logging data DAM according to this disclosure will now be described in relation with FIGS. 2.B, 3.A, 3.B, 3.C and 7.

FIG. 2.B schematically shows a cross-section into a portion of a cased wellbore and illustrates two consecutive logging data frames measured by the measuring device MD1 shown in FIG. 2.A.

At a first instant $t_1$ a first logging data frame F11 corresponding to a first position of the sensor array SA1D is acquired (step S1-ACQ F1) and stored in the memory MEM A movement of the downhole assembly shown by arrows in FIG. 2.A may occur (step S2-MVT). Such a movement may be a rotation, a displacement or a combination thereof.

At a second instant $t_2$ a second logging data frame F12 corresponding to a second position of the sensor array SA1D is acquired (step S3-ACQ F2) and stored in the memory MEM.

When the first F11 and second F12 logging data frames are separated by an integer number of full rotation of the measuring device MD1, the first F11 and second F12 logging data frames overlap at least partially each other, forming an overlapping area OA1 (also shown in FIG. 3.C).

FIG. 3.A schematically illustrates a first measurement curve $Ct_1$ relating to the first logging data frame F11, each measurement being performed by each of the 8 sensors of the 1D sensor array SA1D example of FIG. 2.A corresponding to the first position SA1D1 at the first instant $t_1$.

FIG. 3.B schematically illustrates a second measurement curve $Ct_2$ relating to the second logging data frame F12, each measurement being performed by each of the 8 sensors of the 1D sensor array SAID example of FIG. 2.A corresponding to the second position SA1D2 at the second instant $t_2$.

FIG. 3.C schematically illustrates the best overlap between the first $Ct_1$ and the second $Ct_2$ measurement curves from which the relative change in the depth ΔDP can be derived (step S5-CALC ΔDP/ΔAZ). The best overlap can be determined by comparing the first $Ct_1$ and the second $Ct_2$ measurement curves (step S4-COMP F1/F2). This may be done by calculating, for various relative changes in the depth ΔDP, the area between the curves OZ1, and determining the relative change in the depth ΔDP at which the area between the curves OZ1 is the most favorable. Advantageously, the best overlap is determined by applying a correlation or semblance method (e.g. a known auto-correlation, cross-correlation, or statistical correlation method, etc. . . . ). Optionally, the actual depth value DP can also be calculated based on the determined relative change in the depth ΔDP and a prior estimation of the depth (step S5-CALC DP/AZ).

The azimuth may be determined in an analogous way with a substantially horizontal sensor array and will not be further described.

As an alternative not represented in the drawings, it may be impossible to have a vertical line of sensors. Such a configuration may arise when the sensor size is relatively large, or when there are mechanical constraints to the position of the sensors within the downhole assembly. In this case, by monitoring the azimuth (e.g. with a magnetometer) while the downhole assembly is rotating, it is possible to synthesize a vertical line of data using a sensor array having a non-straight line configuration. After all the sensors have passed through one single azimuth, the measurement of each sensor may approximate the measurement that would have been taken by a vertical line of sensors. Subsequently, the depth measuring method of this disclosure may be applied in an analogous way as for a substantially vertical sensor array.

FIG. 4.A schematically shows a cross-section into a portion of a cased wellbore and illustrates the depth and/or azimuth measuring device MD2 according to a second embodiment of this disclosure.

The depth and/or azimuth measuring device MD2 is coupled to a 2D sensor array SA2D. In the example of FIG. 4.A, the 2D sensor array comprises a matrix of sensors enabling measuring depth and/or azimuth. The 2D sensor array may be a specific sensor which function is only to be used in the determination of the depth and/or azimuth. Alternatively, the 2D sensor array may be part of the logging tool TL or the drilling assembly DA (see FIGS. 1.A and 1.B) which function is to determine the physical property of the geological formation GF, casing or cementing CS. In this example, the sensor array SA2D comprises resistivity sensors and provides imaging of geological formation resistivity.

The depth and/or azimuth measuring device MD2 comprises an electronic arrangement EA comprising a memory buffer MEM coupled to a processing module PRO. The processing module PRO is coupled to the 2D sensor array SA2D.

The method of measuring depth and/or azimuth of logging data DAM according to this disclosure will now be described in relation with FIGS. 4.B, 5.A, 5.B and 7.

FIG. 4.B schematically shows a cross-section into a portion of a cased wellbore and illustrates two consecutive logging data frames measured by the measuring device MD2 shown in FIG. 4.A.

At a first instant $t_1$ a first logging data frame F21 corresponding to a first position of the sensor array SA2D is acquired (step S1-ACQ F1) and stored in the memory MEM.

A movement of the downhole assembly shows by arrows in FIG. 4.A may occur (step S2-MVT). Such a movement may be a rotation, a displacement or a combination thereof.

At a second instant $t_2$ a second logging data frame F22 corresponding to a second position of the sensor array SA2D is acquired (step S3-ACQ F2) and stored in the memory MEM.

The first F21 and second F22 logging data frames overlap at least partially each other, forming an overlapping area OA2. Preferably, between the first $t_1$ and second $t_2$ instant, the sensor array SA2D does not move such that the sensor array falls outside the boundaries of the first logging data frame F21 in order to enable overlapping. However, the second frame can be taken after one, or multiple rotations, provided that an overlapping area can be determined.

FIG. 5.A schematically illustrates a first logging data frame F21 measured by the sensors of the 2D sensor array SA2D corresponding to the first position at the first instant $t_1$.

FIG. 5.B schematically illustrates a second logging data frame F22 measured by the sensors of the 2D sensor array SA2D corresponding to the second position at the second instant $t_2$.

The bottom right area of the first logging data frames F21 is similar to the top left area of the second logging data frame F22. The overlapping area OA2 is delimited by a broken rectangle in FIGS. 5.A and 5.B. A correlation or semblance method is applied (step S4-COMP F1/F2) in order to precisely determine the locations of identical features in the two successive logging data frames. Then, the displacements of the features from frame-to-frame can be determined. When the best overlapping area is determined, the relative change in the depth ΔDP and in the azimuth ΔAZ can be calculated (step S5-CALC ΔDP/ΔAZ). Then the depth DP and azimuth AZ may be determined in a similar way as described in relation with the first embodiment (step S5-CALC DP/AZ).

The correlation or semblance method can be applied on the complete logging data frames, or alternatively on selected portion logging data frame extracted from said complete frames.

Optionally, other measurements may further correct (step S6-DP.$DP_0$/AZ=$AZ_0$) the estimation of the depth and/or the estimation of the azimuth as determined above.

As an example, with a sensor array of 8 electrodes having a dimension of about 3 inches, the relative position of the electrodes is known with a precision of 0.005 inch. This leads to a small error that keeps adding always in the same direction. A more important limitation causing the accumulation of errors is the resolution of the sensor around +/−0.2 inch.

The nature of the accumulated error results in a depth accuracy good at a short-scale, but deteriorated on a longer scale. In contrast, other measurements are good on long scales but have insufficient resolution on short scales. Therefore, the estimation of the absolute depth from the present disclosure can be improved by using an independent depth value $DP_0$ measured for example by a surface depth measuring system and/or a weight on tool measuring system. The absolute azimuth value may be improved by an independent azimuth value $AZ_0$ measured for example by a magnetometer. Long and short scale estimates can be combined using optimal known filtering/statistical methods Thus, the absolute depth and azimuth measurements can be enhanced on an absolute level.

Other measurements of displacement such as the use of accelerometers with double integration methods may also be used to achieve enhancement of the measurement. This adjustment can be made in real time if there is a communication between the surface equipment and the downhole assembly. This readjustment can also be made when the downhole assembly is returned to the surface and when both the surface and the downhole logging data are stored in a memory using the same time reference.

In logging while drilling applications, the standoff i.e. the distance from the sensor array to the wellbore wall may vary. This change in the standoff will result in a defocusing of the logging data frame that is measured. In such case, the correlation or semblance method needs to be able to correlate subsequent logging data frames even if the standoff has changed. Another measurement (e.g. an ultrasonic measurement) may assist to predict the amount of standoff and thereby give a prediction of amount of change in the logging data frames.

It is to be noted that in both embodiments hereinbefore described, the location of the sensor array in the downhole assembly is arbitrary. For example, the sensor array may be positioned into the downhole assembly, into a probe pad of a logging tool, on a stabilizer of a drilling tool. The position of sensor array mainly depends on the type of measurement (electromagnetic, nuclear . . . ), the necessity to perform measurements close to the geological formation, minimizing the influence of the standoff, etc. . . .

Further, in both embodiments, the calculation of the relative depth and/or azimuth values may be performed in the downhole assembly itself, e.g. by the processing module PRO, or by the surface equipment SE, e.g. by a computer, the measurements being stored in a memory of the tool and downloaded when the tool returns uphole.

FIGS. 6.A and 6.B show typical logging data image measured with a downhole assembly.

FIG. 6.B illustrates a logging data image measured with a downhole assembly where depth was measured according to the prior art. This image shows a range of depth between 9732 and 9734 feet where the downhole assembly did not move or move slower than estimated by the surface measuring device. However, this situation was not detected, resulting in a stretched region SR (represented by a broken line rectangle).

FIG. 6.A illustrates a logging data image measured with a downhole assembly where depth was measured according to this disclosure.

The logging data image of FIG. 6.A representing the resistivity of the geological formation for a depth DP interval and an azimuth AZ interval is obtained after the depth over a determined range of time has been calculated according to this disclosure, logging data frames and other data have been acquired during this determined range of time. With the disclosed method or device, the case of downhole assembly not moving or slowly moving can be detected, thus preventing the stretched region that can be seen in prior art logging image.

Referring again to FIG. 7, the relative changes in depth (ΔDP) and azimuth (ΔAZ) that are calculated at step S5 can be used to determine rate of penetration and rate of rotation. During the depth and/or azimuth measurements, the time instant (t1) at which the first logging data frame F11 is acquired and the time instant (t2) at which the second logging data frame is acquired can be recorded. The rate of penetration can then be given by ΔDP/(t2-t1) and the rate of rotation by ΔAZ/(t2-t1). In some implementations, the rate of penetration and/or rate of rotation can be evaluated for multiple depth and/or azimuth changes using corresponding timestamps as a drilling assembly or logging tool moves along a wellbore so as to determine a profile of the rate of penetration and/or rate of rotation during drilling or logging. Such profile can then be used to calculate, e.g., the average of or variation in rate of penetration and/or rate of rotation for a given time period or along a given depth/azimuth interval.

The actual depth (DP) and azimuth (AZ) that are calculated at step S5 can be used to correct a depth/azimuth measurement system that the drilling assembly or logging tool uses at the earth's surface or elsewhere at the assembly or tool (for instance, downhole using magnetometers for example). The drilling assembly or logging tool records measurements of properties of earth formations with respect to time of recording. The depth/azimuth measurement system disposed at the earth's surface or elsewhere at the assembly or tool can be used in conjunction with a surface recording system to generate a time-depth/azimuth record of movement of the drilling assembly or logging tool along the wellbore where the depth and/or azimuth of the drilling assembly or logging tool in the wellbore is correlated to the time of each recorded depth/azimuth of the drilling assembly or logging tool. To generate a conventional "well log", which displays formation property measurements with respect to depth/azimuth in the wellbore, the time "stamped" measurements, which are stored in the drilling assembly or logging tool, are subsequently correlated to the time-depth/azimuth record made at the earth's surface by the surface recording system.

During drilling or logging of a wellbore, changes in axial loading (e.g., "weight on bit") on the drilling assembly or logging tool may cause some degree of difference between the actual depth/azimuth of the drilling assembly or logging tool in the wellbore, and the depth/azimuth recorded by the surface-located depth/azimuth measurement system. The time-corresponding calculations of the actual depth and/or azimuth of the drilling assembly or logging tool as described herein can be correlated to the time-depth/azimuth record made at the earth's surface or elsewhere at the assembly or tool and then be used to adjust the time-depth/azimuth record to compensate for depth/azimuth record inaccuracies that may be caused by drilling string axial compression and/or elongation as a result of changes in axial loading during drilling or logging.

Final Remarks

Though two embodiments with a particular 1D and 2D sensor arrays were described, it will be apparent for a person skilled in the art that the methods and devices described herein are also applicable with sensor array comprising any number of sensors and that may be positioned in any spatial distribution (regular distribution, staggered distribution . . . ). For example, the sensor of the array may be distributed according to a spiral like pattern.

The methods and devices were described in relation with resistivity measurements. Nevertheless, it will be apparent for a person skilled in the art that the methods and devices described herein are also applicable to other kind of measurements from which it is possible to derive overlapping logging data frames, e.g. nuclear, ultrasonic or optical measurements, etc. . . .

Further, this disclosure is not limited to specific correlation or semblance methods, since there are many ways of comparing two curves or two images.

Though the methods and devices were described in relation with onshore hydrocarbon well location, it will be apparent for a person skilled in the art that the method and devices described herein are also applicable to offshore hydrocarbon well location. Finally, it will be apparent for a person skilled in the art that application of the methods and devices described herein to the oilfield industry is not limitative as the invention can also be used in others types of surveys.

The drawings and their description hereinbefore illustrate rather than limit this disclosure.

Any reference sign in a claim should not be construed as limiting the claim. The word "comprising" does not exclude the presence of other elements than those listed in a claim. The word "a" or "an" preceding an element does not exclude the presence of a plurality of such element.

The invention claimed is:

1. A method of determining a rate of penetration and/or rate of rotation of a drilling assembly or logging tool while drilling or logging a wellbore, the method comprising the steps of:

at a first time instant, acquiring and storing a first logging data frame using a first array of sensors, and at a second time instant, acquiring and storing a second logging data frame using a second array of sensors, wherein the second logging data frame overlaps at least partially the first logging data frame, and wherein the method further comprises the steps of:

comparing the first and second logging data frames, determining a relative change in depth and/or azimuth between the first and second logging data frames, calculating the rate of penetration and/or rate of rotation based on the relative change in depth and/or azimuth determined and a difference between the first and second time instants, wherein the logging data relate to at least one property of a zone surrounding the wellbore.

2. A method according to claim 1, wherein the first and second sensor arrays are the same sensor array.

3. A method according to claim 1, wherein the method further comprises the steps of:

correlating the rate of penetration and/or rate of rotation calculated to a time correspondent measurement of a depth and/or azimuth of the drilling assembly or logging tool made by a measuring device at the earth's surface, and correcting the measurement of the depth and/or azimuth of the drilling assembly or logging tool made by the measuring device at the earth's surface.

4. A method according to claim 1, wherein the method further comprises the steps of:

calculating an actual depth and/or azimuth of the drilling assembly or logging tool based on the relative change in depth and/or azimuth determined, and correcting a time correspondent measurement of a depth and/or azimuth of the drilling assembly or logging tool made by a measuring device at the earth's surface using the actual depth and/or azimuth calculated.

5. A method according to claim 1, wherein the step of comparing the first and second logging data frames includes determining an overlapping area between the first and second logging data frames.

6. A method according to claim 5, wherein the step of determining the overlapping area includes evaluating the coherence of the first and second logging data frames by applying a correlation method on both logging data frames.

7. A method according to claim 5, wherein the step of determining the overlapping area includes evaluating the similarity of the first and second logging data frames by applying a semblance method on both logging data frames.

8. A method according to claim 1, wherein the logging data comprise mechanical, electromagnetic, nuclear, acoustic, or ultrasonic measurements.

9. A method according to claim 1, wherein the first and second logging data frames comprise 1D images or 2D images.

10. The method according to claim 1, wherein the method is carried out by a non-transitory computer readable medium containing computer instructions stored therein for causing a computer processor to perform a program for a rate of penetration and/or rate of rotation determining device arranged to be deployed into a wellbore, the program comprising a set of instructions that, when loaded into a program memory of the rate of penetration and/or rate of rotation determining device, causes the rate of penetration and/or rate of rotation determining device to carry out the steps of the method of determining a rate of penetration and/or rate of rotation of a drilling assembly or logging tool while drilling or logging the wellbore.

11. A device for determining a rate of penetration and/or rate of rotation of a drilling assembly or logging tool while drilling or logging a wellbore, the device being coupled to at least a sensor array for measuring logging data related to at least one property of a zone surrounding the wellbore, and comprising a memory buffer and at least one processing module, wherein the processing module of the rate of penetration and/or rate of rotation determining device is arranged to:

at respective first and second time instant, acquire and store into the memory buffer a first logging data frame using a first array of sensors and a second logging data frame using a second array of sensors, the logging data relating to at least one property of a zone surrounding the wellbore, the second logging data frame overlapping at least partially the first logging data frame, compare the first and second logging data frames, determine a relative change in depth and/or azimuth between the first and second logging data frames, and calculate the rate of penetration and/or rate of rotation based on the relative change in depth and/or azimuth determined and a difference between the first and second time instants.

12. A device according to claim 11, wherein the first and second sensor arrays are the same sensor array.

13. A device according to claim 11, wherein the first and second sensor arrays comprise a 1D sensor array or a 2D sensor array.

14. A device according to claim 11, wherein the processing module of the rate of penetration and/or rate of rotation determining device is further arranged to:

correlate the rate of penetration and/or rate of rotation calculated to a time correspondent measurement of a depth and/or azimuth of the drilling assembly or logging tool made by a measuring device at the earth's surface, and correct the measurement of the depth and/or azimuth of the drilling assembly or logging tool made by the measuring device at the earth's surface.

15. A device according to claim 11, wherein the processing module of the rate of penetration and/or rate of rotation determining device is further arranged to:

calculate an actual depth and/or azimuth of the drilling assembly or logging tool based on the relative change in depth and/or azimuth determined, and correct a time correspondent measurement of a depth and/or azimuth of the drilling assembly or logging tool made by a measuring device at the earth's surface using the actual depth and/or azimuth calculated.

16. A device according to claim 11, wherein the device is part of one of a drilling assembly and a logging tool.

* * * * *